United States Patent [19]

Sakamoto et al.

[11] 4,384,646

[45] May 24, 1983

[54] PRESSURIZED PRESERVATION CONTAINER

[75] Inventors: Noriaki Sakamoto, Nishinomiya; Yoshihiko Yoshikawa, Kobe, both of Japan

[73] Assignees: Sumitomo Rubber Industries, Ltd., Hyogo, Japan; Sumitomo Rubber Industries, Ltd., Hyogo, Japan

[21] Appl. No.: 243,861

[22] Filed: Mar. 16, 1981

[51] Int. Cl.[3] ..... B65D 81/20; B65D 85/00

[52] U.S. Cl. ..... 206/315 B; 220/450; 150/1

[58] Field of Search ..... 206/315 B, 524.8, 334; 220/404, 231, 450; 150/1

[56] References Cited

U.S. PATENT DOCUMENTS

| | | | |
|---|---|---|---|
| 2,889,078 | 6/1959 | Thomas | 220/450 |
| 3,556,186 | 1/1971 | Bestborne | 150/1 |
| 3,742,994 | 7/1973 | Pensak | 150/1 |
| 4,267,928 | 5/1981 | Curry, Jr. | 220/404 |

*Primary Examiner*—William T. Dixson, Jr.

*Attorney, Agent, or Firm*—Birch, Stewart, Kolasch & Birch

[57] ABSTRACT

A pressurized preservation container which includes an inner bag made of a sheet-like material prepared by laminating plastics with a metallic foil, and an outer container accommodating the inner bag therein so as to be combined with the inner bag for constituting the pressurized preservation container.

6 Claims, 4 Drawing Figures

PRESSURIZED PRESERVATION CONTAINER

Figure 1:
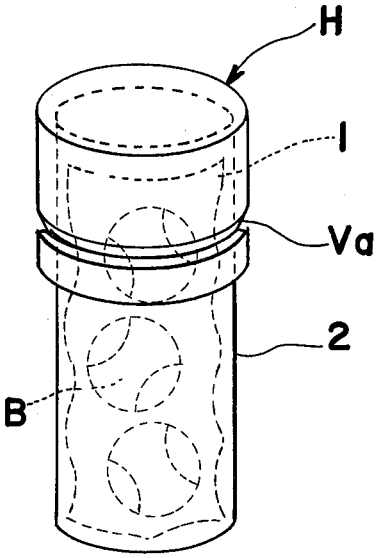

The present invention generally relates to a package and more particularly, to a pressurized preservation container which includes an inner bag formed by a sheet composed of a plastic material laminated on a metallic foil, and an outer container, for example, of paper material combined with said inner bag.

With respect to items to be subjected to the pressurized preservation system as referred to above, there may be included, for example, balls for games maintaining internal pressures such as tennis balls, balls for soft base ball, etc. food articles having inert gases sealed therein, soda drinks accompanied by generation of gas, etc. Although the present invention will be described mainly with reference to tennis balls, it should be noted that the concept of the present invention is not limited in its application to such tennis balls alone, but may readily be applied to various articles for pressurized preservation in general.

Commonly, tennis balls which are normally produced to have a predetermined internal pressure slightly higher than atmospheric pressure, tend to become unusable due to reduction of the internal pressure with time, and therefore, they are generally kept in a sealed can and stored under pressure. Even in the above practice, however, airtightness is not necessarily perfect, and there have been such disadvantages that not only are the cans to be employed expensive costwise, but empty cans after use give rise to problems related to waste disposal, and moreover, such cans constitute a considerable weight when a large number of tennis balls are to be transported.

In order to overcome the disadvantages as described above, it has conventionally been attempted to pack the tennis balls with the use of paper boxes or paper tubes, but such a practice has only been actually applied to the so-called "pressure-less" tennis balls requiring no pressurization.

Meanwhile, another known practice of packing hard tennis balls in air tight bags also has drawbacks such that, since the outer periphery of the airtight bag is exposed to the atmosphere, the internal pressure tends to be reduced during preservation due to application of pressure and heat thereto from the outside, and thus, has not been put into actual application.

Accordingly, an essential object of the present invention is to provide an improved pressurized preservation container composed of an inner bag and an outer container combined with said inner bag, which is high in airtightness and convenient for transportation, while being free from problems related to waste disposal when emptied.

Another important object of the present invention is to provide an improved pressurized preservation container of the above described type which is simple in construction, and can be readily manufactured on a large scale at low cost.

In accomplishing these and other objects, according to one preferred embodiment of the present invention, there is provided a pressurized preservation container which includes an inner bag made of a sheet-like material prepared by laminating plastics with a metallic foil, and an outer container accommodating the inner bag there in so as to be combined with the inner bag for constituting the pressurized preservation container.

By the arrangement according to the present invention as described above, there is presented an improved pressurized preservation container which is sufficiently airtight and convenient to transport, without inviting particular problems related to waste disposal, with substantial elimination of the disadvantages inherent in the conventional containers of this kind.

Figure 2:
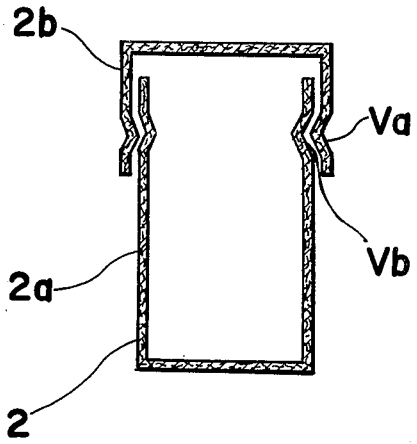
Figure 3:
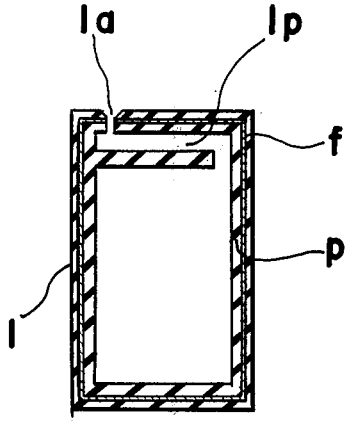
Figure 4:
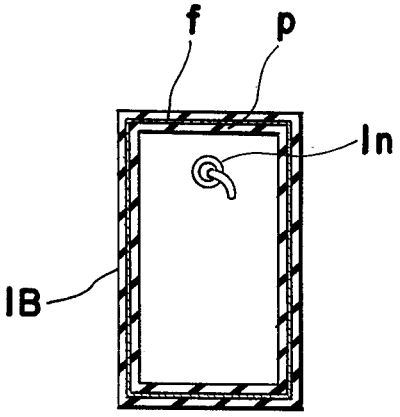

These and other objects and features of the present invention will become apparent from the following description taken in conjunction with the preferred embodiments thereof with reference to the accompanying drawings, in which;

FIG. 1 is a perspective view of an improved pressurized preservation container according to one preferred embodiment of the present invention, FIG. 2 is a schematic side sectional view of an outer container employed in the arrangement of FIG. 1, FIG. 3 is a schematic side sectional view of an inner bag employed in the arrangement of FIG. 1, and FIG. 4 is a view similar to FIG. 3, which particularly shows a modification thereof.

Before the description of the present invention proceeds, it is to be noted that like parts are designated by like reference numerals throughout the several views of the accompanying drawings.

Referring now to the drawings, there is shown in FIG. 1 an improved pressurized preservation container H according to one preferred embodiment of the present invention. In FIG. 1, the pressurized preservation container H generally comprises an outer container 2 (FIG. 2), for example, of multi-layer paper material in a cylindrical configuration further including a lower casing 2*a* open at its upper edge and formed with an annular recess Vb at its peripheral surface adjacent to the upper edge thereof and an upper casing or cap 2*b* having a protrusion Va formed adjacent to its lower open edge so as to be engageable with said annular recess Vb of the lower casing 2*a* for constituting a cap retaining mechanism, and an inner bag 1 (FIG. 3) made of a sheet material formed by laminating thermo-fusible plastics P such as polypropylene, polyethylene, polyamide, polyester, etc. with a metallic foil f such as an aluminum foil and the like.

In the above arrangement, articles to be stored under pressure, for example, tennis balls B are accommodated in the inner bag 1, and the inner bag 1 is placed in the outer container 2. Subsequently, gas such as air, nitrogen gas, carbon dioxide or the like is charged into the inner bag 1 either directly or through utilization of an expanding agent, such as dry-ice, etc. via a gas charging opening 1*a* provided at the upper portion of the bag 1, and then, the opening 1*a* is sealed to achieve a sufficient airtightness. In the above case, in order to prevent generation of a large noise due to rapid discharge of the gas upon unsealing, a by-pass portion 1*p* is provided in the interior of the inner bag 1 in a position adjacent to the charging opening 1*a* as shown in FIG. 3.

It is to be noted here that as shown in a modified inner bag 1B of FIG. 4, the by-pass portion 1*p* described as provided in the bag 1 of FIG. 3 may be replaced by a nozzle cap 1*n* to achieve the similar effect.

It should be also noted that the annular recess Vb and corresponding protrusion Va described as provided in the outer container 2 of FIG. 2 and acting as the cap retaining mechanism may be omitted for simplification of construction depending on necessity, and that the outer container described as made of the paper material in the foregoing embodiment may be modified to be prepared, for example, by plastic materials.

Hereinbelow, the EXAMPLE is inserted for the purpose of illustrating the present invention, without any intention of limiting the scope thereof.

EXAMPLE

An inner bag having dimensions of 18 cm in length and 13 cm in width was made of a sheet material prepared by laminating a polyester film of approximately 12 μm in thickness onto the outer face of an aluminum foil of about 15 μm in thickness, and also laminating a polyethylene film of about 75 μm onto the inner face of said aluminum foil. Subsequently, two tennis balls were placed in said inner bag thus prepared, which was then accommodated into a cylinder or outer container made of multi-layer paper material of 7.5 cm in the inner diameter and 15 cm in height.

Thereafter, air was charged into the inner bag, with a by-pass portion provided at the air charging port of the inner bag, which was then heat-sealed through simultaneous use of a stopper to achieve the internal pressure of about 0.9 kg/cm$^2$. The cylinder was stored for 60 days at room temperature, with a cap applied to the outer container, and thus, upon opening of the outer container, no reduction of the internal pressure was noticed both in the inner bag and hard tennis balls.

As is clear from the foregoing description, according to the present invention, by the simultaneous use of the outer container, expansion of the inner bag upon application of external pressure or temperature to said inner bag may be advantageously suppressed by the outer container so as to maintain a sufficient airtightness, while the pressurized preservation container of the present invention which may be produced at low cost, is not only convenient for transportation, but invites no problems related to waste disposal, and consequently, provides such effects as saving of resources and energy.

Although the present invention has been fully described by way of example with reference to the accompanying drawings, it is to be noted that various changes and modifications will be apparent to those skilled in the art. Therefore, unless otherwise such changes and modifications depart from the scope of the present invention, they should be construed as included therein.

What is claimed is:

1. An airtight, pressurized preservation container which comprises an inner bag for accommodating an article to be stored, said inner bag comprising a sheet-like material of a metallic foil laminated on at least one side thereof with a plastic material and having an inlet port for introducing pressurized gas, said inlet port being adapted to be sealed after the introduction of said gas, and a cylindrical outer container for accommodating and supporting said inner bag, said outer container comprising a lower casing with an open end having an upper edge and an upper casing with an open end having a lower edge, each of said upper edge of said lower casing and said lower edge of said upper casing comprising a means for detachably securing said upper casing to said lower casing.

2. The pressurized preservation container of claim 1, wherein said inner bag is provided with a by-pass portion formed juxtapositioned to said inlet port.

3. The pressurized preservation container of claim 1, wherein said inlet port of said inner bag comprises a nozzle cap.

4. The pressurized preservation container of claim 1, wherein said outer container is made of paper material in the form of a cylinder.

5. The pressurized preservation container of claim 1, wherein said outer container is made of plastic material.

6. The pressurized preservation container of claim 1, wherein said means for detachably securing said upper and lower casings comprises alternate annular recess and protrusion means in one or the other respective edges of said casings.

* * * * *